United States Patent [19]

Hannebaum

[11] 4,076,009

[45] Feb. 28, 1978

[54] FIREPLACE

[75] Inventor: Harold W. Hannebaum, Bellevue, Id.

[73] Assignee: The Raymond Lee Organization, Inc., a part interest

[21] Appl. No.: 698,257

[22] Filed: Jun. 21, 1976

Related U.S. Application Data

[63] Continuation-in-part of Ser. No. 580,808, May 27, 1975, Pat. No. 3,986,488.

[51] Int. Cl.[2] ..... F24B 1/02

[52] U.S. Cl. ..... 126/120; 126/15 R; 126/60; 126/146

[58] Field of Search ..... 126/60, 61, 65, 4, 15 R, 126/146, 77, 193, 120

[56] References Cited

U.S. PATENT DOCUMENTS

| | | | |
|---|---|---|---|
| 165,393 | 7/1875 | White | 126/60 |
| 1,135,478 | 4/1915 | Wood | 126/60 |
| 1,382,880 | 6/1921 | Armstrong | 126/60 |
| 3,499,432 | 3/1970 | Hannebaum | 126/120 |
| 3,910,251 | 10/1975 | Andrew | 126/120 |

*Primary Examiner*—John J. Camby
*Assistant Examiner*—Larry I. Schwartz

[57] ABSTRACT

A generally cylindrical casing is hollow, and is supported by a base so that the axis of the casing is horizontal. A vertical partition divides the casing into a fire chamber and a smaller exhaust chamber. The smaller chamber is vented to the outside atmosphere by a chimney. The partition does not completely isolate the chambers, but enables them to be interconnected through a small gap at its bottom. Extending rearwardly along the curved portion of the casing are two oppositely disposed parallel horizontal elongated air intake slits at the level of the bottom of the partition. The major portion of the section of the casing that surround the fire chamber is of glass. The base can have a horizontal hollow half cylindrical shell at its top which supports the casing and a vertical hollow intake duct extending from a bottom opening in the base to the slits to feed air thereto.

5 Claims, 6 Drawing Figures

FIREPLACE

CROSS REFERENCE TO CO-PENDING APPLICATIONS

The present application is a continuation-in-part of the co-pending application Ser. No. 580,808, filed May 27, 1975 now U.S. Pat. No. 3,986,488 and entitled "FIREPLACE".

SUMMARY OF THE INVENTION

This invention is directed toward a small fireplace that is designed to be both an efficient source of heat and an item of decoration. It uses a fire that is fed by two oppositely directed rotating vortexes of fresh air, and that thus swirls around in the fire chamber of the fireplace, producing a desirable visual appearance.

The invention uses a generally cylindrical hollow casing that has both ends closed and is divided into a fire chamber and a smaller exhaust chamber located behind it. A partition separates the chambers, but leaves a space between its lowest edge and the casing to allow smoke to pass from the fire chamber into the exhaust chamber. The exhaust chamber is vented to the outside atmosphere by a chimney to void the combusted gases.

The casing rests upon, and is spaced from a horizontally elongated hollow bottom cylindrical half section which forms the top of a supporting base. The base has a hollow intake duct extending from a bottom opening in the base along the space between the section and the bottom of the casing to a pair of oppositely disposed horizontally elongated parallel slits in the casing.

These slits, which are coplanar with a horizontal plane passing through the bottom of the partition, allow air to enter the fire chamber. The shape of the chamber causes the air to be swirled around violently into two oppositely directed rotating vortexes, raising combustion efficiency. In use, this fireplace is so efficient that even when the casing surrounding the fire chamber is constructed of glass, the glass very seldom needs cleaning. The fire produced in the fire chamber is always in violent motion, resulting in an attractive decorative effect.

DETAILED DESCRIPTION OF PREFERRED EMBODIMENTS

Figure 1:
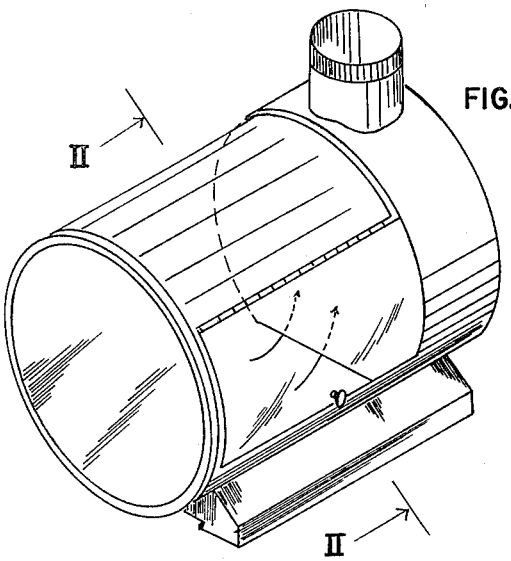
FIG. 1 is a perspective drawing of the invention.
Figure 2:
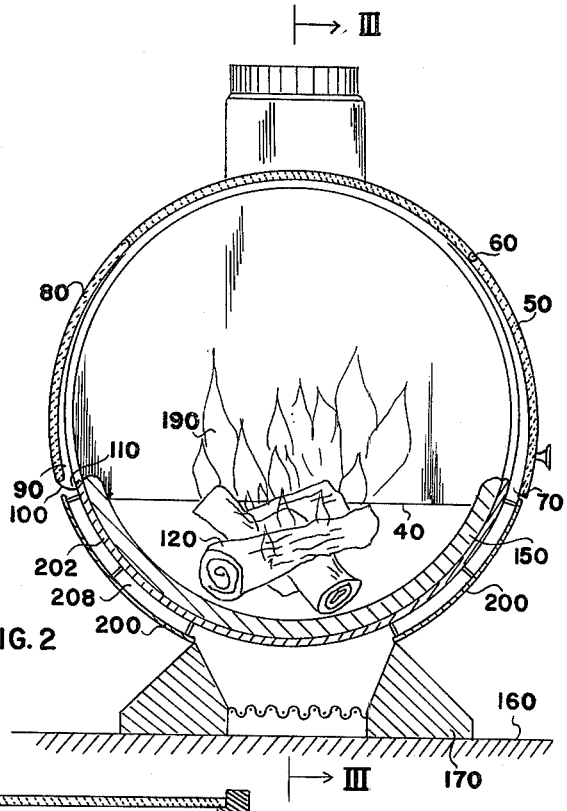
FIG. 2 is a view along line 2—2 of FIG. 1.
Figure 3:
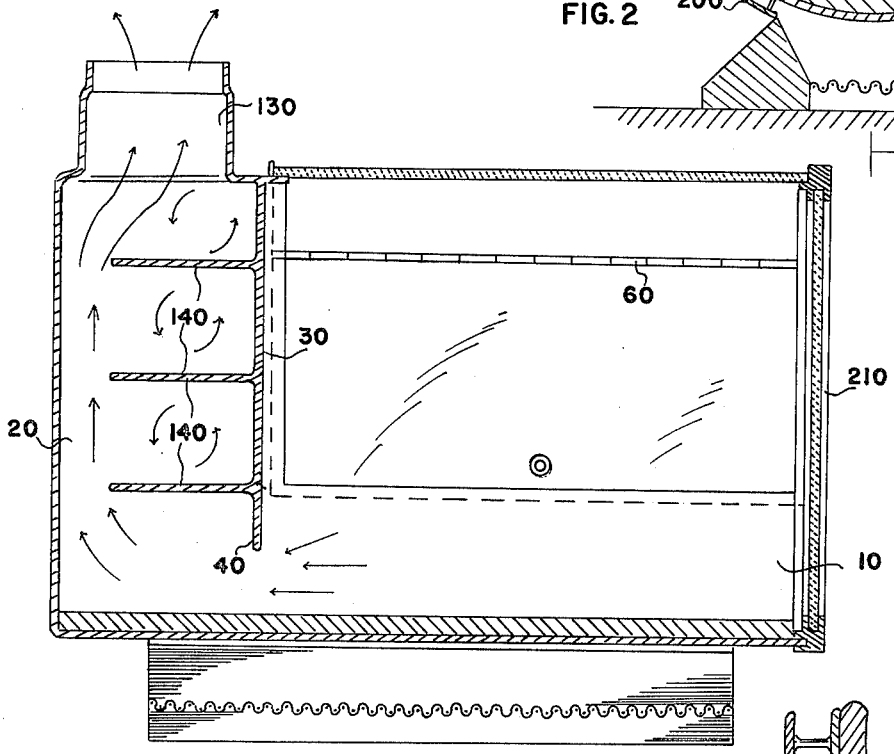
FIG. 3 is a view along line 3—3 of FIG. 2.
Figure 5:
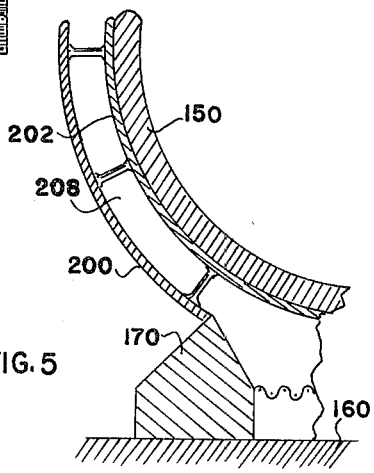
FIG. 5 is a detail view illustrating the supporting and spacer geometry employed in the casing and base connections.
Figure 6:
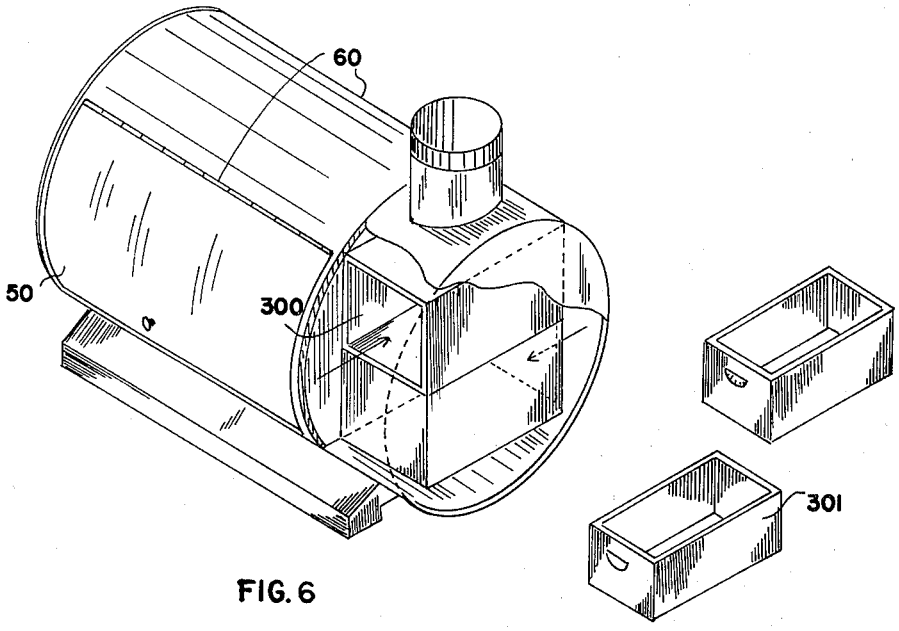
FIG. 6 shows a modification of the invention.
Figure 4:
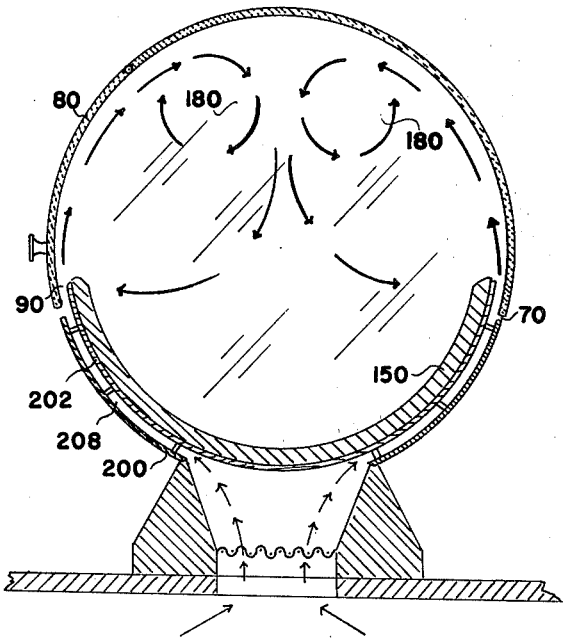
FIG. 4 is a view similar to FIG. 2 but illustrating the air flow in more detail.

Referring now to FIGS. 1–6, a casing with a horizontal axis is generally cylindrical, hollow, and has closed ends. It is divided into a fire chamber 10 and an exhaust chamber 20 by a vertical partition 30. The casing surrounding the smaller chamber 20 is made of metal, while most of the casing surrounding the chamber 10 is made of glass. The partition has a horizontal bottom edge 40, and in the space between that bottom edge and the casing, the exhaust gases created in the fire chamber can pass into the exhaust chamber. Chamber 20 can be divided into a second vertical partition 160 into an exhaust chamber section 20A and an outer region 20B containing a removable drawer 300 wherein food can be heated.

A curved glass lid 50 is hinged to the casing by hinge 60 and forms part of the curved portion of the casing. A thin horizontal slit 70 is formed between the bottom of the lid and the bottom section 20 of the casing. This slit extends horizontally rearwardly parallel to the axis of the cylinder and terminates at the point where the partition is located. This slit 70 is located in the horizontal plane that includes the bottom edge of the partition. This slit as explained below allows air to enter the fire chamber even when the lid is in its most fully closed position. Similarly, a panel 80 identical to the lid but not hingedly attached to the casing juts out in the same fashion. Another thin horizontal slit 90 is formed which is parallel to and identical to slit 70. However, louver 100 is hingedly attached to the casing section 202 by hinge 110 and can be moved up and down. to block off or open slit 90 as needed. Both these slits have the function of allowing air to pass into the fire chamber to enable fuel 120 to be combusted therein.

The exhaust chamber is vented to the outside atmosphere through chimney 130. Below the chimney in the exhaust chamber are three like, parallel baffles 140 that are supported by the partition.

The bottom of the fire chamber is lined with fire clay 150, and the whole device is supported on horizontal surface 160 by the base 170. More particularly, the base has a top section in the form of a horizontally elongated hollow bottom half cylinder 200 which supports casing section 202 and yet is generally spaced therefrom. The base has a hollow vertical duct 204 which extends upwards from a screened air intake opening 206 in the bottom of the duct to the shell space 208 between cylinder 200 and section 202. This space in turn connects the top end of the duct 204 to the slits 70 and 90. By this means, outside air is drawn upward through the duct 204, space 108 and slits 70 and 90 into the combustion chamber.

Fuel is introduced into the fire chamber, lit, and allowed to burn with the lid closed. The air is drawn into the fire chamber at relatively high velocity, because of the narrowness of the slits. The fresh air taken into the fire chamber generally follows the arrows in FIG. 4, forming two oppositely directed swirling vortexes 180 and thus generating violent, swirling flames 190. The exhaust gases then pass under partition 30 into the exhaust chamber, where they can exit the device through the chimney. The baffles prevent ashes from flying out the chimney, but the amount of ashes to be dealt with is very low, on coal-wood or any other fuel, because of the extreme efficiency of the combustion process.

In use, the louver is adjusted so as to get the most efficient combustion. It may be opened or closed as needed. It has been found that the combustion in the fire chamber is so efficient when the louver is properly adjusted that the inside surfaces of the glass portion of the casing seldom, if even, need cleaning.

Although the invention has been described with particular reference to the drawings, the protection sought is to be limited only by the terms of the claims which follow.

I claim:

1. A fireplace, comprising:

a hollow, generally cylindrical casing with horizontal axis and with closed ends and having two parallel elongated horizontal air intake slits parallel to the axis, said slits extending rearwardly along the curved surface of the casing to an end point intermediate the ends of the casing;

a base having a top section in the form of a horizontally elongated hollow bottom half cylinder provided with means for receiving and supporting the bottom portion of said casing, thereby forming a space between said section and said bottom portion which communicates with said slits, said base having a hollow vertical air intake duct connected between a bottom air intake opening in the base and said space to feed air from the outside of the base into the interior of the casing, said base supporting the casing upon a horizontal surface; and a vertical partition placed at the endpoint and dividing the casing into a fire chamber and an exhaust chamber, the partition restricting all communication between the chambers to an opening between the casing and the bottom of the partition.

2. The fireplace of claim 1 further including:

a chimney venting the exhaust chamber to the outside atmosphere.

3. The fireplace of claim 2 wherein the two slits define a horizontal plane containing the bottom edge of the partition.

4. The fireplace of claim 3 wherein the exhaust chamber supports at least one horizontal baffle located below the chimney.

5. The fireplace of claim 4 wherein the major portion of the section of the casing that surrounds the fire chamber is constructed of glass.

* * * * *